US006394416B2

(12) United States Patent
von Gaisberg

(10) Patent No.: US 6,394,416 B2
(45) Date of Patent: May 28, 2002

(54) DEVICE FOR OPERATING A GAS EXCHANGE VALVE

(75) Inventor: Alexander von Gaisberg, Fellbach (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/780,488

(22) Filed: Feb. 9, 2001

Related U.S. Application Data

(63) Continuation-in-part of application No. PCT/EP99/06025, filed on Aug. 17, 1999.

(30) Foreign Application Priority Data

Aug. 20, 1998 (DE) ..... 198 37 837

(51) Int. Cl.[7] ..... F16K 31/02

(52) U.S. Cl. ..... 251/129.16; 251/337; 123/90.11; 123/90.65

(58) Field of Search ..... 251/129.16, 337; 123/90.11, 90.65

(56) References Cited

U.S. PATENT DOCUMENTS 3,882,833 A * 5/1975 Longstaff ..... 123/90.65 X
4,420,141 A * 12/1983 Goloff ..... 251/337
4,682,574 A * 7/1987 Kreuter ..... 251/129.16 X
5,199,392 A * 4/1993 Kreuter et al. ..... 251/129.16 X
6,003,481 A * 12/1999 Pischinger et al. ..... 123/90.11
6,021,749 A * 2/2000 Galsberg ..... 123/90.11
6,085,704 A * 7/2000 Hara ..... 251/129.16 X
6,176,208 B1 * 1/2001 Tsuzuki et al. ..... 123/90.11
6,260,522 B1 * 7/2001 Stolk et al. ..... 251/129.16 X
6,262,498 B1 * 7/2001 Leiber ..... 251/129.16 X

FOREIGN PATENT DOCUMENTS

DE 195 29 152 A1 2/1997
DE 196 47 305 C1 2/1998
EP 0 814 238 A1 12/1997

* cited by examiner

*Primary Examiner*—Joseph A. Kaufman
*Assistant Examiner*—John Bastianelli
(74) *Attorney, Agent, or Firm*—Klaus J. Bach

(57) ABSTRACT

In a device for operating a gas exchange valve with a hydraulic play compensating element of an internal combustion engine, which device includes an electromagnetic actuator having spaced valve opening and valve closing magnets between which an armature is movably supported for operating the gas exchange valve and wherein the valve is biased in a valve closing direction by a valve closing spring and in a valve opening direction by a valve opening spring which together form a valve oscillation structure having an equilibrium position in which the armature which is operatively connected to the valve is essentially disposed centrally between the magnets, the opening spring has a steeper spring force characteristic line and a lower pre-stress value than the closing spring.

2 Claims, 2 Drawing Sheets

DEVICE FOR OPERATING A GAS EXCHANGE VALVE

This is a continuation-in-part application of international application PCT/EP99/06025 filed Aug. 17, 1999 and claiming the priority of German application 198 37 837 filed Aug. 20, 1998.

BACKGROUND OF THE INVENTION

The invention relates to a device for operating a gas exchange valve of an internal combustion engine with an electromagnetic actuator including opening and closing magnets having an armature disposed therebetween for operating the valve and a hydraulic play compensation element for eliminating play in the valve operating mechanism during operation of the valve.

Electromagnetic actuators for actuating gas exchange valves usually include two operating magnets, an opening magnet and a closing magnet, with opposite spaced pole faces between which an armature is arranged so as to be moveable co-axially with the valve. The armature acts on a valve stem of the gas exchange valve directly or indirectly via an armature tappet. Actuators operating as mass oscillators include a pre-stressed spring mechanism engaging the armature. The spring mechanism usually consists of two pre-stressed compression springs, of which an upper spring, the valve opening spring, biases the gas exchange valve in the valve opening direction and a lower spring, the valve closing spring, biases the valve in the valve closing direction against the force of the opening spring. When the magnets are not energized, the armature is held by the valve springs in a position of equilibrium between the magnets. DE 35 13 107 C2 shows a gas exchange valve with an actuator, in which the armature, together with an opening spring, is biased toward the valve stem via an armature tappet and against the force of a closing spring, which engages the valve stem of the gas exchange valve.

When the actuator is operated during engine startups, either the closing magnet or the opening magnet is briefly over-energized. Or, as described in DE 33 07 070 C2, the armature is excited with an oscillation build-up routine at its resonance frequency, so as to be moved out of its position of equilibrium.

DE 195 29 152 A1 discloses an electromagnetic actuator including an electromagnet which can automatically move the armature from its position of rest against the force of a return spring. This is achieved by the valve springs being designed with a progressively rising force characteristic curve, specifically in such a way that the magnetic force of at least one of the magnets always exceeds the spring force in the range between an equilibrium position and one of the respective end positions. In this case, the valve springs may be designed to be identical or they may have different characteristics such that the position of equilibrium of the armature is displaced towards one of the magnets.

When the gas exchange valve is closed, the armature bears against the pole face of the energized valve closing magnet and is held by the latter. The closing magnet further pre-stresses the valve opening spring. In order to open the gas exchange valve, the closing magnet is de-energized and the opening magnet is energized. The opening spring accelerates the armature beyond the position of equilibrium and the armature is then pulled toward the opening magnet. When the armature abuts the pole face of the opening magnet it is retained by the opening magnet. In order to close the gas exchange valve again, the opening magnet is de-energized and the closing magnet is energized. Then the closing spring accelerates the armature beyond the position of equilibrium towards the closing magnet. The armature is pulled up by the closing magnet, abuts the pole face of the closing magnet and is retained by the latter.

Variables which are not taken into account from the outset or which change over time, such as, for example, manufacturing tolerances of individual components, thermal expansions of different materials, differing spring rigidities of the upper and lower valve springs and settling phenomena due to the aging of the valve springs, etc., may lead to a situation where the position of equilibrium determined by the valve springs does not coincide with an energy-induced center position between the pole faces or where there is no defined center position. Furthermore, variables of this kind and wear on the valve seat may lead to the armature bearing against the pole face of the closing magnet before the gas exchange valve is fully closed. Hot combustion gases flowing through valves, which are not fully closed, destroy the valve seats. On the other hand, it is possible due to different thermal expansions, that the armature is not in contact with the pole face of the closing magnet, when the gas exchange valve is closed so that there is a steep increase in the energy requirement of the closing magnet. Moreover, this condition also results in a reduced opening stroke of the gas exchange valve, whereby the throttle losses during the charge exchange cycle increase and the gas exchange efficiency is impaired.

Prior German application DE 19 647 305.5 discloses a valve operating mechanism with a play-compensating element, wherein an actuator is mounted in a floating manner in a cylinder head. The actuator opens and closes a gas exchange valve via an armature and two spaced electromagnets movably receiving therebetween an armature. A spring mechanism is arranged between the actuator and a spring support disc of the gas exchange valve including an upper spring which is a valve opening spring supported on the actuator and a lower spring which is a valve closing spring supported on the cylinder head. Located on the side remote from the gas exchange valve between a cover plate and the actuator is a play-compensating element which compensates for both positive and negative valve play by axial displacement of the valve actuator.

The play-compensating element has a first hydraulic element with a play-compensating piston disposed in a cylinder. The play-compensating piston is located between a first pressure space facing away from the gas exchange valve and controlled as a function of the internal combustion engine and a second pressure space facing the gas exchange valve. Located in the piston is a non-return valve, which is held in the closing position by a retaining spring. In the event of excess pressure in the first pressure space, the non-return valve opens in the direction of the second pressure space. The retaining spring is designed in such a way that the non-return valve does not open when there is no play and therefore interrupts communication between the two pressure spaces.

Between the play-compensating piston and the cylinder, a defined leakage path remains which forms a throttle connection, through which pressure medium can slowly escape from the second pressure space. The play-compensating element is supported on the upper cover plate, which is firmly connected to the cylinder head. The play-compensating element can transmit either only compressive forces or, in another version, during the closing operation, also tensile forces.

If the gas exchange valve does not close fully because the actuator moved too far in the direction of the gas exchange valve, that is to say there is a negative play, the pressure in the second pressure space increases by the force of the closing spring of the gas exchange valve. The pressure medium escapes from the second pressure space via the throttle connection due to the pressure increase until the gas exchange valve is again fully closed.

When the gas exchange valve closes properly, but there is still play between the armature tappet and the gas exchange valve, the valve closing spring of the gas exchange valve does not act on the second pressure space. The pressure in the second pressure space consequently falls below that of the first pressure space, so that the non-return valve opens against the force of the retaining spring. The pressure medium flows then from the first pressure space into the second pressure space until the play is eliminated. This action may last, for several operating cycles of the valve, but eventually play-free operation is established. However, since the position of the actuator changes during play compensation, the position of equilibrium of the valve springs also changes, so that the equilibrium position no longer coincides with the oscillation center position of the valve. This changes the oscillation behavior of the spring and valve arrangement, the energy requirements of the magnets and the opening and closing actions of the gas exchange valves.

DE 196 31 909 A1 discloses a method for adjusting the position of rest of the armature of an electromagnetic actuator, such as it is used, for example, on reciprocating-piston internal combustion engines, in order to operate gas exchange valves. The position of rest corresponds to the position of equilibrium as determined by the pre-stress of the valve springs when the magnets are de-energized. In this method, in each case, the inductance of the two electromagnets is measured and the position of the armature in the position of equilibrium with respect to the pole faces of the electromagnets is determined from a comparison of the two measured inductance values. During measurement, the armature is in the position of equilibrium.

It is known from DE 39 20 976 A1, that for an electromagnetic actuator operating on the principle of a spring-mass oscillator, the operating stroke of the armature may be changed by a change in the position of the pole faces of the actuator magnets and that the center of oscillation can be adapted to the new position of the pole faces by a change in the position of one or more spring support points.

It is the object of the present invention to provide a device for operating gas exchange valves with a play-compensating element, in such a way that the center position of the armature changes only slightly as a function of wear of the valve seat.

SUMMARY OF THE INVENTION

In a device for operating a gas exchange valve with a hydraulic play compensating element of an internal combustion engine, which device includes an electromagnetic actuator having spaced valve opening and valve closing magnets between which an armature is movably supported for operating the gas exchange valve and wherein the valve is biased in a valve closing direction by a valve closing spring and in a valve opening direction by a valve opening spring which together form a valve oscillation structure having an equilibrium position in which the armature, which is operatively connected to the valve, is essentially disposed centrally between the magnets, the valve opening spring has a steeper characteristic spring force line and a lower pre-stress value than the valve closing spring.

Preferably, the spring force induced equilibrium position of the armature corresponds approximately to the center position of the armature between the magnets.

The opening spring is preferably designed in such a way that, over the full length of the valve stroke, it relaxes from the force necessary for initiating the opening movement of the valve to zero. A slight remaining residual pre-stress is generally advantageous for safety reasons. In order to achieve such complete relaxation, the opening spring according to the invention has a steeper characteristic curve than an opening spring as employed according to the prior art. In order to obtain the necessary cumulative rigidity of the two valve springs, the closing spring is designed so as to have a flatter characteristic curve. Since the characteristic curves of the two valve springs are unequal, the equilibrium position of the armature would normally not be the same as the oscillation center position of the system. This change is compensated for in that the two valve springs are pre-stressed with a force affecting the equilibrium position in opposition to their characteristic curves, such that the spring energy-induced equilibrium position of the armature essentially coincides with the center position between the magnets.

In a new internal combustion engine, the valve spring must be installed with a higher pre-stress, that is, a higher residual closing force than is necessary for keeping the valve closed. This is done because, with wear on the valve seat, the closing spring relaxes over the service life. With the flatter characteristic curve such an allowance may be reduced, because the spring experiences a smaller loss of pre-stress for the same wear distance. Furthermore, lower forces occur in all ranges, with the exception of the situation where the gas exchange valve is closed.

The center position of the armature changes with the wear distance as a function of the ratio of the closing spring rigidity to the cumulative rigidity of the two valve springs. In the design according to the invention, this ratio is always lower than 0.5. As a result, the permissible oscillation center position range of the system is exceeded only after a relatively long running time, so that a long service life is achieved for the system. Since the oscillation center position change resulting from the wear of the valve seat is always in the same direction, it is advantageous if the initial position of equilibrium is set to be somewhat off-center in the opposite direction taking into account a certain amount of wear during the running-in phase and the first operating period.

Since no superfluous energy is stored in the valve springs, the springs can be designed to be slightly smaller than it is customary, thus resulting in a smaller construction space.

Details of the invention and the advantages resulting therefrom will become apparent from the following description of an exemplary embodiment on the basis of the accompanying drawings.

DESCRIPTION OF A PREFERRED EMBODIMENT

Figure 1:
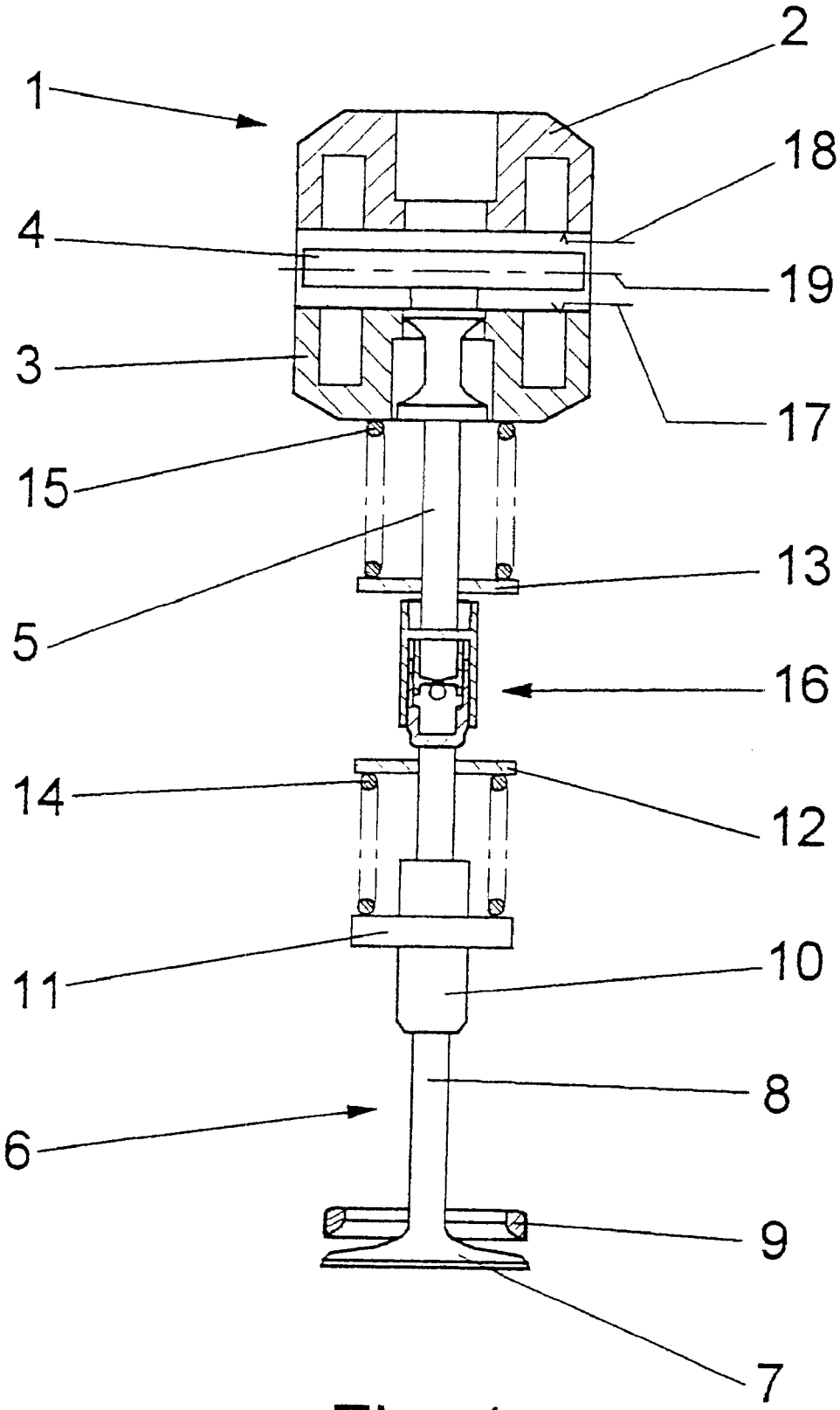
FIG. 1 shows an electromagnetic actuator and a gas exchange valve with a play-compensating element during operation in a position of equilibrium.

FIG. 1 shows an electromagnetic actuator 1 which operates a gas exchange valve 6 disposed on a cylinder head of an internal combustion engine which is not illustrated in detail. The actuator 1 includes an upper valve closing magnet 2 and a lower valve opening magnet 3 and also an armature 4, which is arranged so as to be axially movable between the magnets 2 and 3. The armature 4 acts on a valve stem 8 of the gas exchange valve 6 via an armature tappet 5 and a hydraulic play-compensating element 16. Located at the free end of the valve stem 8 is a valve disc 7, which co-operates with a valve seat ring 9 embedded in the cylinder head of the engine. A valve guide 10 guides the valve stem 8 in the cylinder head for linear opening and closing movement of the valve.

When the magnets 2 and 3 are de-energized, a spring system, consisting of a valve closing spring 14 and of a valve opening spring 15, holds the armature 4 in a spring energy-induced center position of equilibrium 19, that is, an oscillation center position, which preferably corresponds to a center position between the two magnets. The valve closing spring 14 is supported, at one end, on the cylinder head via a closing spring rest 11 and, at the opposite end, on the valve stem 8 via a closing spring support plate 12. The opening spring 15 is supported at one end on the actuator 1 and at its other end, via an opening spring support plate 13, on the armature tappet 5.

FIG. 1 shows the armature 4 in the center position 19 during an operating phase. The play-compensating element 16 ensures that the gas exchange valve 6 closes without any play and the armature 4 bears against the closing magnet 2 in the end position 18 when the gas exchange valve 6 is closed. The closing spring 14 exerts a residual closing force on the gas exchange valve 6 when the valve 6 is closed.

Figure 2:
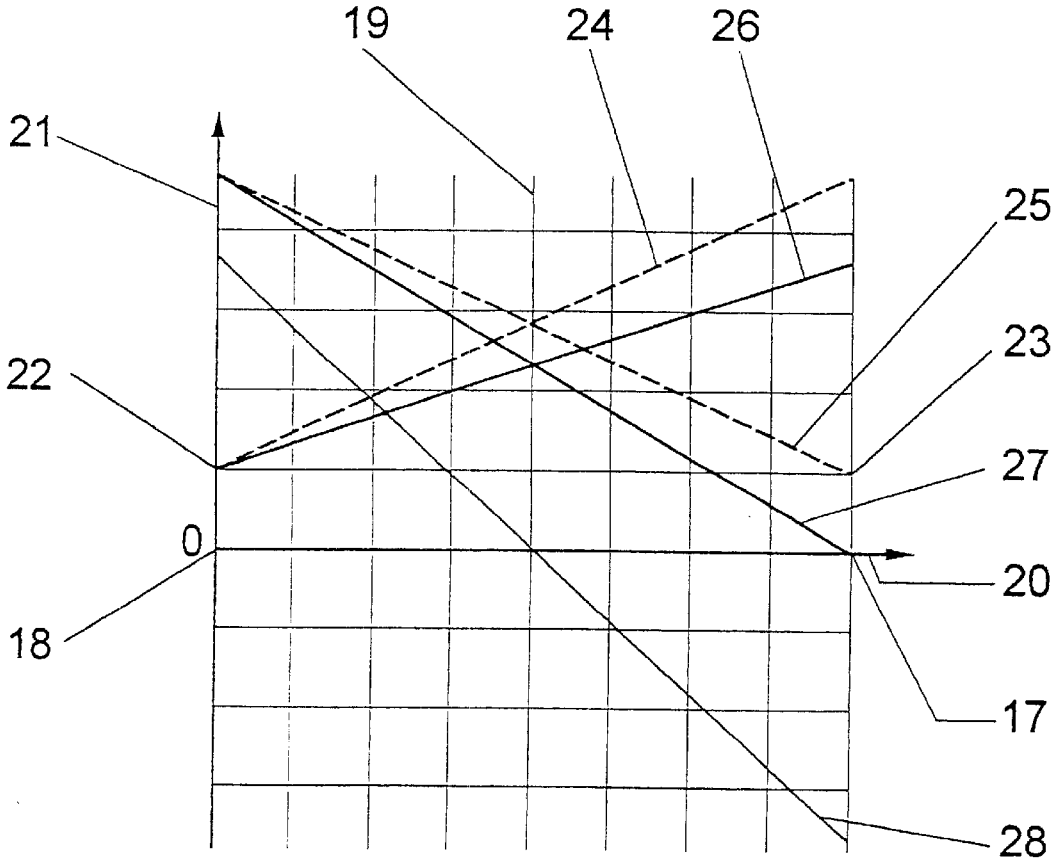
FIG. 2 is a graph indicating the forces generated by the valve springs over a stroke of the gas exchange valve.

In the graph according to FIG. 2, the spring forces are illustrated, which are effective during the stroke movement of the gas exchange valve 6 between the end position 17 when the gas exchange valve 6 is open and the end position 18 when the gas exchange valve is closed. The abscissa 20 represents the opening travel distance of the valve. The spring forces of the valve closing spring 14 and of the valve opening spring 15 are illustrated on a coordinate 21. A characteristic line 24 illustrates the force profile of a conventional closing spring 14 whereas the characteristic curve 26 shows the forces generated by a valve closing spring design according to the invention. Correspondingly, the forces generated by a characteristic curve 25 of a conventional valve opening spring and a characteristic curve 27 for an opening spring 15 according to the invention are indicated. A cumulative characteristic line 28 for the two valve springs 14, 15 (curves 26 and 28) intersects the abscissa 20 in the center thereof (line 19). Out of a valve center position (19) the part of the line 28 above the abscissa 20 illustrates the closing movement of the valve and the part lying below the abscissa 20 illustrates the opening movement of the gas exchange valve 6. The cumulative characteristic curve 28, which is critical for the oscillation behavior of the actuator 1, is the same for the conventional spring design and the spring design according to the invention, although closing and opening springs of different stiffness are used.

The spring design according to the invention differs from the conventional spring design in that the characteristic line 27 for the opening spring 15 relaxes to zero at the end position 17 in the valve opening stroke, whereas the conventional characteristic line 25 still has a pre-stress value 23 at this end position 17. As a result, the characteristic line 27 of the opening spring extends at a slope which is steeper than the characteristic line 25 of a prior art opening spring and also steeper than the characteristic line 26 of the closing spring 14. The closing spring 14, which has a pre-stress value 22 in the end position 18 corresponding to the closed valve position is also flatter than the characteristic line 24 of the conventional closing spring. The slopes of the characteristic lines 26, 27 are coordinated with the pre-stress 22 of the closing spring 14 and the pre-stress of the opening spring 15, which is equal to zero in the exemplary embodiment, in such a way that the cumulative characteristic curve 28 intersects the abscissa 20 at a center location 19. Due to the flatter characteristic line 26 of the closing spring 14, the influence of wear of the valve seat ring 9 and valve disc 7 on the displacement of the position of equilibrium 19 in relation to the energy-center position is lower than in a conventional spring design.

What is claimed is:

1. A device for operating a gas exchange valve with a hydraulic play-compensating element of an internal combustion engine, said device including an electromagnetic actuator having a valve opening magnet and a valve closing magnet arranged in spaced relationship, an armature axially movably arranged between said spaced valve opening and closing magnets, a valve with a valve stem arranged so as to be operable by said armature, valve opening and valve closing springs engaging said valve for biasing said valve in opposite directions such that said valve has an equilibrium position, wherein said armature is disposed essentially in the center between said magnets when the magnets are de-energized, said opening spring having a steeper characteristic spring force line and a lower pre-stress value than said closing spring.

2. A device according to claim 1, wherein, in the initial assembly state of said device, the position of equilibrium of said armature is displaced from the center position between said magnets towards said opening spring so that, with wear-in of said valve, said equilibrium position moves toward said center position.

* * * * *